US006093224A

United States Patent [19]

Jones

[11] Patent Number: 6,093,224

[45] Date of Patent: Jul. 25, 2000

[54] LONG BURNING FIRE STARTER

[76] Inventor: Gary T. Jones, 1912 Ceder Loop Dr., West Weber, Utah 84405

[21] Appl. No.: 09/298,882

[22] Filed: Apr. 26, 1999

[51] Int. Cl.[7] ..... C10L 11/00

[52] U.S. Cl. ..... 44/502; 44/504; 44/544; 44/545; 44/572; 44/606

[58] Field of Search ..... 44/502, 504, 544, 44/545, 572, 606

[56] References Cited

U.S. PATENT DOCUMENTS

| | | | |
|---|---|---|---|
| 2,816,013 | 12/1957 | Powell | 44/502 |
| 3,232,721 | 2/1966 | Coyner | 44/545 |
| 3,338,690 | 8/1967 | Calhoun | 44/544 |
| 3,351,444 | 11/1967 | Ryan et al. | 44/502 |
| 4,272,252 | 6/1981 | Altman | 44/502 |
| 5,326,379 | 7/1994 | Gardner | 44/445 |

*Primary Examiner*—Jerry D. Johnson

[57] ABSTRACT

A long burning fire starter produced by mixing diatomaceous earth particles with wood pellets; soaking the particles and pellet mix in a liquid burning agent and, if desired, a dye and fragrance; coating the soaked mix with wax; and packaging the soaked and coated mix in an airtight package.

7 Claims, No Drawings

LONG BURNING FIRE STARTER

BRIEF DESCRIPTION OF THE INVENTION

1. Field of the Invention

This invention relates to easily ignited fire starter products used as igniters for other long burning materials.

2. Prior Art

It has long been recognized that the easiest way to ignite hard to light burnable fuels is to place them in the presence of an easily ignited fuel and then to ignite the easily lighted fuel as a primer for the hard to light fuel.

Typically, a long burning fuel such as charcoal briquettes is ignited by pouring a flammable liquid over the briquettes to be ignited and the flammable liquid is ignited. The flammable liquid is dangerous to use and store and many injuries have resulted from spraying the liquid onto a poorly burning, previously lighted, pile of briquettes and with a resultant "flash back" of the fire into the container for the fluid and an explosion of the container contents.

Flammable liquids also have a distinct unsuitable odor and taste that may be transferred to food products being cooked over charcoal briquettes.

Easily ignited fire starter products are also frequently used by hunters, campers and others under adverse weather conditions to ignite wet wood. Such products are often carried in vehicles or kept in homes as part of an emergency preparedness package. All too often the fire starter products are not safe for such storage and/or are ineffective under the conditions existing at the time of use.

OBJECTS OF THE INVENTION

Principal objects of the present invention are to provide a fire starter that is safe to use, without danger of explosion; that can be safely stored for long periods of time; and that will retain its efficacy during such long periods of storage.

Another object is to provide an easily ignited fire starter that will burn sufficiently long to itself be used as a heat source for illumination, warmth and cooking.

Still another object is to provide an easily ignited fire starter material that, when used to ignite charcoal briquettes or other fuels used in cooking will absorb grease drippings resulting from cooking, thereby preventing flame-ups that might adversely affect the cooking process or cause the fire to spread beyond desired limits.

FEATURES OF THE INVENTION

Principal features of the product of the invention include use of a mix of diatomaceous earth and wood pellets as a holder for a liquid burning agent. The liquid burning agent comprises a mixture of odorless mineral spirits and propylene glycol and the holder is saturated with the liquid burning agent. The holder and burning agent are sprayed or immersion coated with paraffin wax that will enhance burning and will prevent evaporation of the liquid burning agent from the holder. The product is packaged in an air tight container, such as a metal can or Mylar package.

Additional objects and features of the invention will become apparent from the following detailed description, disclosing what is presently contemplated as being the best mode of the invention.

DETAILED DESCRIPTION OF THE INVENTION

In the presently preferred embodiment of the invention, a mixture of diatomaceous earth and wood pellets is formed, preferably in a 2:1 (plus or minus 25%) ratio of diatomaceous earth to wood pellets. The diatomaceous earth and wood particles used must pass a ¾ inch mesh. It has been found that the surface area afforded by larger particles is not adequate to hold sufficient additives to provide the necessary heat, for a sufficient time to allow the mixture to effectively serve as an igniting medium in practical sized packages.

The mixture of diatomaceous earth and wood pellets is soaked in a liquid burning agent formed from odorless mineral spirits and propylene glycol, for a minimum of thirty minutes. The liquid burning agent not absorbed by the wood pellets and adhering to the surfaces of the diatomaceous earth particles is drained away.

Hot paraffin wax (melted to temperature of at least 125 degrees Fahrenheit) is sprayed with the liquid burning agent and diatomaceous earth and wood pellet mix to coat the particles and pellets and to keep the liquid burning agent used from evaporating away and to create cohesively bound globules of the mix. Each cohesively bound globule then includes soaked and coated diatomaceous particles and wood pellets that will result in easily ignited wood pellets and heat retaining and consequently longer burning liquid burning agent and/or wax within the interstices and on the outer surfaces of diatomaceous earth particles.

The mixed product is allowed to cool and is packaged in air tight (aluminum cans or Mylar packages, for example) packages to further prevent drying of the product and loss of liquid burning agent. So packaged, the product can be stored for several years and still be effective as a fire starter, when needed.

If it is desired to add a dye or a scent to the product, this can be accomplished by mixing a soluble dye containing a D.L. Limonene, with scent, with the diatomaceous earth particles and wood pellets after soaking in the liquid burning agent and before coating the particles and pellets with wax. It has been found that a mixing time of at least fifteen minutes is necessary to insure thorough mixing of the dye into the product.

The fire starter product of the invention has been found ideally suited as an igniter for charcoal briquettes, commonly used for barbecue cooking purposes. The product not only provides a high heat, long lasting igniter, but after the wax has melted off and the liquid burner agent has been burned off the diamataceous earth absorbs grease drippings from the food being cooked and allows such drippings to be easily removed from the barbecue grill. This, of course, prevents the grease from adhering to the grill surfaces, collecting in the grill, flaming up and burning out the grill.

Although a preferred embodiment of the invention has been herein disclosed, it is to be understood that such disclosure is by way of example and that other variations are possible without departing from the subject matter coming within the scope of the following claims, which subject matter I regard as my invention.

I claim:

1. A long burning fire starter comprising a mixture of diatomaceous earth particles and wood pellets soaked in a liquid burning agent comprising a mixture of odorless mineral spirits and propylene glycol and coated with paraffin wax and packaged in an air tight package.

2. A long burning fire starter as in claim 1, wherein the diatomaceous earth particles and wood pellets pass through a ¾ inch mesh.

3. A long burning fire starter as in claim 2, wherein the diatomaceous earth particles and wood pellets contain an added dye and fragrance.

4. A process of making a long burning fire starter comprising the steps of:

(a) making a mix of diatomaceous earth particles and wood pellets that will pass a ¾ inch mesh;

(b) soaking said mixture of diamataceous earth particles and wood pellets in a liquid burning agent comprising a mix of odorless mineral spirits and propylene glycol;

(c) coating said soaked diamataceous earth particles and wood pellets with paraffin wax; and (d) packaging said soaked and coated diatomaceous earth particles and wood chips in an airtight package.

5. A process as in claim 4, wherein said mixed diatomaceous earth particles and wood pellets are soaked in said selected liquid burning agent for at least thirty minutes, with excess liquid burning agent being thereafter drained off.

6. A process as in claim 5, wherein the diatomaceous earth particles and wood pellets are mixed in a ratio of 2:1, plus or minus 25%.

7. A process as in claim 6, further including soaking said mixture of diamataceous earth particles and wood pellets in a dye and fragrance before coating said mix with wax.

* * * * *